US008581686B2

(12) United States Patent
Galla et al.

(10) Patent No.: US 8,581,686 B2
(45) Date of Patent: Nov. 12, 2013

(54) ELECTRICALLY ACTIVATED SURFACE MOUNT THERMAL FUSE

(75) Inventors: Matthew P. Galla, Mountain View, CA (US); Jianhua Chen, Sunnyvale, CA (US); Martyn A. Mattheisen, Fremont, CA (US)

(73) Assignee: Tyco Electronics Corporation, Berwyn, PA (US)

( * ) Notice: Subject to any disclaimer, the term of this patent is extended or adjusted under 35 U.S.C. 154(b) by 200 days.

(21) Appl. No.: 12/383,595

(22) Filed: Mar. 24, 2009

(65) Prior Publication Data

US 2010/0245022 A1 Sep. 30, 2010

(51) Int. Cl.
*H01H 37/76* (2006.01)
*H01H 85/143* (2006.01)
*H01H 71/20* (2006.01)

(52) U.S. Cl.
USPC ..... 337/409; 337/231; 337/314; 337/315; 337/317; 337/388; 337/148; 29/623

(58) Field of Classification Search
USPC ..... 337/231, 409, 148, 314, 315, 317, 388
See application file for complete search history.

(56) References Cited

U.S. PATENT DOCUMENTS 2,386,094 A * 10/1945 Duerkob ..... 337/164
2,613,297 A * 10/1952 Laing ..... 337/164
2,790,049 A * 4/1957 Mcalister ..... 337/405
3,003,045 A * 10/1961 Tichenor ..... 200/61.08
3,155,800 A * 11/1964 Denton ..... 337/409
3,180,958 A * 4/1965 Merrill ..... 337/409
3,198,914 A * 8/1965 Baran et al. ..... 337/405
3,629,766 A * 12/1971 Gould, Jr. ..... 337/239
3,761,856 A * 9/1973 Mantelet ..... 337/409
3,840,834 A 10/1974 Obenhaus et al.
4,030,061 A * 6/1977 Gaskell et al. ..... 337/409
4,034,326 A * 7/1977 Hill et al. ..... 337/34
4,058,784 A * 11/1977 Gaia ..... 337/164
4,167,724 A * 9/1979 McCaughna ..... 337/408
4,210,893 A * 7/1980 Hara ..... 337/407
4,314,224 A * 2/1982 Plasko ..... 337/408

(Continued)

FOREIGN PATENT DOCUMENTS

DE 10-2005-045778 A1 3/2007
EP 0562438 A1 9/1993

(Continued)

OTHER PUBLICATIONS

International Search Report for International Application No. PCT/US2010/00874, mailed May 18, 2010.

(Continued)

*Primary Examiner* — Bradley Thomas

(57) ABSTRACT

A reflowable thermal fuse includes a conduction element with first and second ends, disposed within a housing. The reflowable thermal fuse also includes an elastic element disposed within the housing and adapted to apply force on the conduction element in an activated state of the reflowable thermal fuse. A restraining element is utilized to secure the elastic element and prevent the elastic element from applying force on the conduction element in an installation state of the reflowable thermal fuse. Application of an activating current through the restraining element causes the restraining element to break and thereby release the elastic element and place the reflowable thermal fuse in the activated state.

20 Claims, 8 Drawing Sheets

(56) References Cited

U.S. PATENT DOCUMENTS

| | | | | | |
|---|---|---|---|---|---|
| 4,352,082 | A | * | 9/1982 | Barry et al. | 337/409 |
| 4,357,590 | A | | 11/1982 | Belhomme | |
| 4,383,236 | A | * | 5/1983 | Urani et al. | 337/403 |
| 4,445,079 | A | | 4/1984 | DeFilippis et al. | |
| 4,451,814 | A | * | 5/1984 | Barry et al. | 337/407 |
| 4,511,876 | A | * | 4/1985 | Urani | 337/244 |
| 4,514,718 | A | | 4/1985 | Birx | |
| 4,533,897 | A | * | 8/1985 | Olson et al. | 337/408 |
| 4,593,262 | A | * | 6/1986 | Krueger | 337/163 |
| 4,620,175 | A | * | 10/1986 | Karr et al. | 337/343 |
| 4,631,626 | A | | 12/1986 | Bohan | |
| 4,685,025 | A | | 8/1987 | Carlomagno | |
| 4,727,347 | A | * | 2/1988 | Cambio et al. | 337/165 |
| 4,727,348 | A | * | 2/1988 | Okazaki | 337/403 |
| 4,808,960 | A | * | 2/1989 | Nixon | 337/4 |
| 4,808,965 | A | * | 2/1989 | Cenky | 337/408 |
| 4,888,573 | A | * | 12/1989 | Dunn | 337/164 |
| 4,906,962 | A | | 3/1990 | Diumstra | |
| 4,992,770 | A | * | 2/1991 | Spalding et al. | 337/164 |
| 5,043,689 | A | * | 8/1991 | Di Troia et al. | 337/165 |
| 5,153,555 | A | | 10/1992 | Enomoto et al. | |
| 5,726,623 | A | | 3/1998 | Camp | |
| 5,781,394 | A | | 7/1998 | Lorenz et al. | |
| 5,831,507 | A | * | 11/1998 | Kasamatsu et al. | 337/4 |
| 5,886,613 | A | * | 3/1999 | Magoon et al. | 337/244 |
| 5,945,903 | A | | 8/1999 | Reddy et al. | |
| 5,990,779 | A | | 11/1999 | Katsuki et al. | |
| 6,236,550 | B1 | | 5/2001 | Mochida et al. | |
| 6,256,183 | B1 | * | 7/2001 | Mosesian | 361/104 |
| 6,300,860 | B1 | | 10/2001 | Hofsass | |
| 6,304,166 | B1 | * | 10/2001 | McLoughlin | 338/21 |
| 6,362,721 | B1 | | 3/2002 | Chen et al. | |
| 6,396,381 | B1 | | 5/2002 | Takeda | |
| 6,914,416 | B2 | | 7/2005 | Thomas et al. | |
| 7,148,785 | B2 | | 12/2006 | Becker et al. | |
| 7,345,570 | B2 | * | 3/2008 | Kawanishi | 337/142 |
| 7,385,474 | B2 | * | 6/2008 | Kawanishi | 337/142 |
| 7,607,829 | B2 | | 10/2009 | Sumida et al. | |
| 2002/0011918 | A1 | | 1/2002 | Miyazaki et al. | |
| 2002/0089408 | A1 | | 7/2002 | Walsh et al. | |
| 2002/0175801 | A1 | | 11/2002 | Katsuki et al. | |
| 2004/0114286 | A1 | | 6/2004 | Sullivan et al. | |
| 2004/0218329 | A1 | | 11/2004 | Becker et al. | |
| 2006/0170528 | A1 | * | 8/2006 | Fukushige et al. | 337/297 |
| 2006/0197647 | A1 | | 9/2006 | Whitney et al. | |
| 2006/0273876 | A1 | * | 12/2006 | Pachla et al. | 337/140 |
| 2007/0020509 | A1 | | 1/2007 | Kim | |
| 2008/0117015 | A1 | * | 5/2008 | Leach | 337/238 |
| 2009/0102595 | A1 | * | 4/2009 | Pachla et al. | 337/297 |
| 2010/0085141 | A1 | * | 4/2010 | Knab et al. | 337/227 |

FOREIGN PATENT DOCUMENTS

| | | | |
|---|---|---|---|
| FR | 2863100 | A1 | 6/2005 |
| FR | 2914108 | A1 | 9/2008 |
| JP | 2006-059568 | A | 3/2006 |

OTHER PUBLICATIONS

International Search Report for International Application No. PCT/US2010/000863, mailed Jul. 20, 2010.

* cited by examiner

ELECTRICALLY ACTIVATED SURFACE MOUNT THERMAL FUSE

BACKGROUND

I. Field

The present invention relates generally to electronic protection circuitry. More, specifically, the present invention relates to an electrically activated surface mount thermal fuse.

II. Background Details

Protection circuits are often times utilized in electronic circuits to isolate failed circuits from other circuits. For example, the protection circuit may be utilized to prevent a cascade failure of circuit modules in an electronic automotive engine controller. Protection circuits may also be utilized to guard against more serious problems, such as a fire caused by a power supply circuit failure.

One type of protection circuit is a thermal fuse. A thermal fuse functions similar to that of a typical glass fuse. That is, under normal operating conditions the fuse behaves like a short circuit and during a fault condition the fuse behaves like an open circuit. Thermal fuses transition between these two modes of operation when the temperature of the thermal fuse exceeds a specified temperature. To facilitate these modes, thermal fuses include a conduction element, such as a fusible wire, a set of metal contacts, or set of soldered metal contacts, that can switch from a conductive to a non-conductive state. A sensing element may also be incorporated. The physical state of the sensing element changes with respect to the temperature of the sensing element. For example, the sensing element may correspond to a low melting metal alloy or a discrete melting organic compound that melts at an activation temperature. When the sensing element changes state, the conduction element switches from the conductive to the non-conductive state by physically interrupting an electrical conduction path.

In operation, current flows through the fuse element. Once the sensing element reaches the specified temperature, it changes state and the conduction element switches from the conductive to the non-conductive state.

One disadvantage with existing thermal fuses is that during installation of the thermal fuse, care must be taken to prevent the thermal fuse from reaching the temperature at which the sensing element changes state. As a result, existing thermal fuses cannot be mounted to a circuit panel via reflow ovens, which operate at temperatures that will cause the sensing element to open prematurely.

SUMMARY

In one aspect, a reflowable thermal fuse includes a conduction element with first and second ends. The reflowable thermal fuse also includes an elastic element adapted to apply a force on the conduction element in an activated state of the reflowable thermal fuse. A restraining element is utilized to secure the elastic element and prevent the elastic element from applying force on the conduction element in an installation state of the reflowable thermal fuse. Application of an activating current through the restraining element causes the restraining element to rupture and thereby release the elastic element and place the reflowable thermal fuse in the activated state.

In another aspect, a method for placing a reflowable thermal fuse on a panel includes providing a reflowable thermal fuse as described above. The reflowable thermal fuse is then placed on a panel that includes pads for soldering the reflowable thermal fuse to the panel. The panel is then run through a reflow oven so as to solder the reflowable thermal fuse to the panel. Finally, an activating current is passed through pins of the reflowable thermal fuse to cause the reflowable thermal fuse to enter the activated state.

DETAILED DESCRIPTION

To overcome the problems described above, a reflowable thermal fuse is provided. Generally, the reflowable thermal fuse includes a conduction element through which a load current flows, and an elastic element adapted to apply a force on the conduction element. In some embodiments, the conduction element incorporates a sensing element. When the temperature of the sensing element exceeds a threshold, the sensing element loses its resilience and becomes susceptible to deformation and/or breakage via the force on the conduction element applied by the elastic element. Eventually, the conduction element mechanically opens under the force, resulting in an open circuit condition. In other embodiments, the sensing element and the conduction element are separate and the sensing element acts to keep the conduction element in a low resistance state.

During a reflow process, the sensing element may lose its resilience. To prevent the force applied by the elastic element from opening the conduction element during installation, a restraining element may be utilized to maintain the elastic element in a state whereby the elastic element does not apply force on the conduction element. After the reflowable thermal fuse is installed on a panel and passed through a reflow oven, the restraining element may be blown by applying an activating current through the restraining element. This in turn activates the reflowable thermal fuse.

The details of the reflowable thermal fuse are set out in more detail below. The accompanying drawings are included to provide a further understanding and are incorporated in and constitute a part of this specification.

Figure 1:
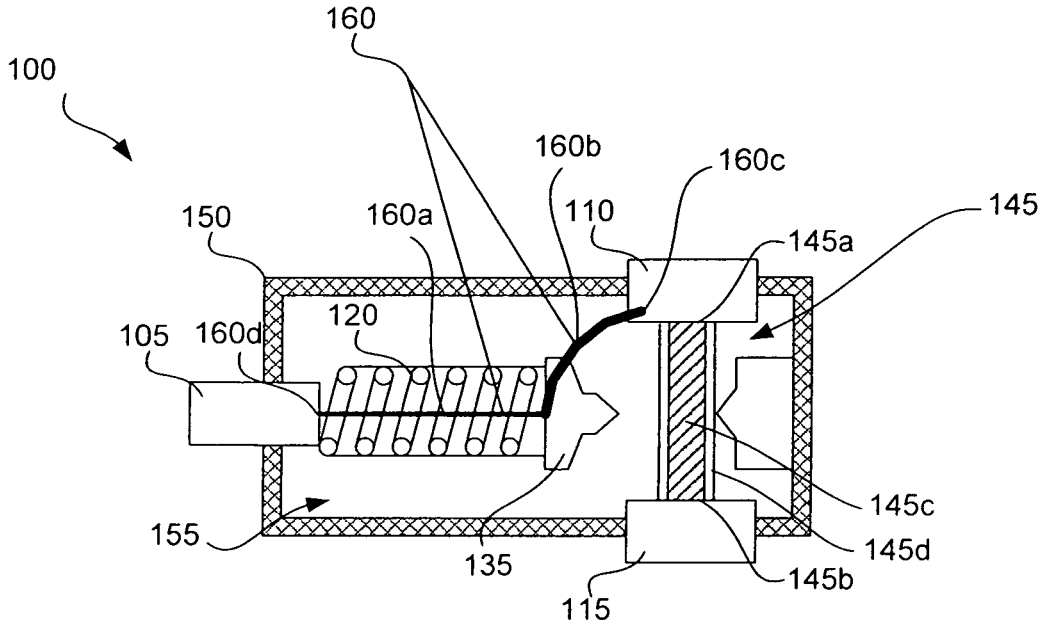
FIG. 1 is a cross sectional view of a first embodiment of a reflowable thermal fuse.

FIG. 1 is a cross sectional view of a first embodiment of a reflowable thermal fuse 100. The reflowable thermal fuse 100 includes a conduction element 145, an elastic element 120, and a restraining element 160*a*. In some embodiments, the conduction element 145, elastic element 120, and restraining element 160 may be disposed within a housing 150 that includes first, second, and third pads (110, 115, and 105) disposed around the housing 150. In other embodiments, the conduction element 145, elastic element 120, and restraining element 160 may be disposed on a substrate, and/or on a circuit board.

The first, second, and third pads (110, 115, and 105) may be utilized to mount the reflowable thermal fuse 100 to a circuit panel (not shown) and bring the conduction element 145 and/or the restraining element 160 into electrical communication with circuitry outside of the housing 150.

The conduction element 145 includes first and second ends 145*a* and 145*b* that may be in electrical communication with the first and second pads 110 and 115, respectively. The conduction element also includes a sensor 145*c*. The sensor 145*c* may be made of any conductive or non-conductive material that has a relatively low melting point and/or loses resilience at a specified temperature, such as solder or plastic. In some embodiments, the sensor 145*c* is disposed inside of an outer tube 145*d* adapted to contain the sensor 145*c* when the sensor 145*c* loses its resilience. For example, the outer tube 145*d* may prevent the sensor 145*c* from freely moving about the inside of the housing 150 when the sensor 145*c* melts. In another embodiment, the sensing element may be contained by surface tension. In an operation of the reflowable thermal fuse, the load current flows through the conduction element 145. For example, the load current from a power supply may flow through the reflowable thermal fuse to other circuitry. In some embodiments, the current that flows through conduction element 145 flows primarily through the sensor 145*c*. In other embodiments, the primary current does not flow through the sensor 145*c*.

In yet other embodiments, the conduction element and sensing element may be separate, but the sensing element may act to keep the conduction element in the low resistance state. For example, the conduction element may include a set of "dry" (unsoldered) contacts that are held together by a sensor comprised of a mass of discrete melting organic material, such as 4-methylumbelliferone as disclosed in U.S. Pat. No. 4,514,718.

Figure 4A:
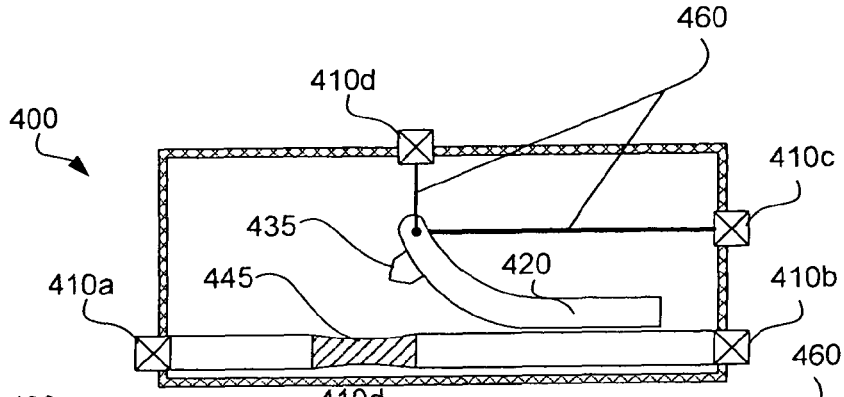
FIG. 4*a* is a cross sectional view of a first embodiment of a reflowable thermal fuse that utilizes four pads.

The elastic element 120 corresponds to any material suitably adapted to apply force on the conduction element 145. In one embodiment, the elastic element corresponds to a coil spring, as shown in FIG. 1. In another embodiment, the elastic element 120 corresponds to a leaf spring 420 as shown in FIG. 4*a*. The Applicant contemplates that the elastic element 120 may be made of other materials and/or structures known to those of skill in the art. For example, the elastic element 120 may correspond to a sponge like material, such as silicone rubber foam. The elastic element 120 may be made of a conductive material, such as copper or stainless steel, or a non-conductive material, such as plastic or fiber reinforced plastic composite. Other materials and structures may be utilized.

In some embodiments, the elastic element 120 may include a tapered tip, such as the tip 135 shown in FIG. 1 or the tip 435 shown in FIG. 4*a*. The tapered tip may be utilized to concentrate the force applied by the elastic element 120 in the tip. This may enable severing the sensor 145*c* during a fault condition as described below. In this case, the sensor 145*c* and the conduction element 145 are one in the same. It is the severing of the conduction element 145 that accomplishes the fusing function.

The restraining element 160 is adapted to secure the elastic element 120 in a state that prevents the elastic element 120 from applying force on the conduction element 145. For example, the restraining element 160 may enable keeping the elastic element 120 in either an expanded or compressed state, thereby preventing the elastic element from applying force against the conduction element 145. The restraining element 160 may correspond to any material capable of conducting electricity. For example, the restraining element 160 may be made of copper, stainless steel, or an alloy. The diameter of the restraining element 160 may be sized so as to enable blowing the restraining element 160 with an activating current. In other words, sourcing a sufficiently high current, or activating current, through the restraining element 160 may cause the restraining element 160 to open. In one embodiment, the activating current may be about 1A. However, Applicants contemplate that the restraining element 160 may be increased or decreased in diameter, and/or another dimension, allowing for higher or lower activating currents.

To facilitate application of an activating current, a first end 160*c* and second end 160*d* of the restraining element 160 may be in electrical communication with various pads disposed about the housing. In the embodiment of FIG. 1, the first end 160*c* and second end 160*c* may be in electrical communication with the first pad 110 and third pad 105, respectively. The activating current may then be applied across the first pad 110 and third pad 105.

In some embodiments, the restraining element 160 may include a first region 160*a* adapted to open when the activating current flows through the restraining element 160 and a second region 160*b* adapted to not open when the activating current flows through the restraining element 160. For example, the first region 160*a* may be of a smaller diameter than the second region 160*b*. This may enable controlling the location where the restraining element 160 opens, which may be advantageous. For example, referring to FIG. 1, the first region 160*a* of the restraining element 160 may extend along the length of the elastic element 120 and the second region 160*b* may be coupled to the tip 135 of the elastic element 120 and a first pad 110. Providing the two regions in the restraining element 160 may prevent the restraining element 160 from opening in a location within the housing 150 where the restraining element 160 may interfere with the operation of the reflowable thermal fuse 100.

Figure 2A:
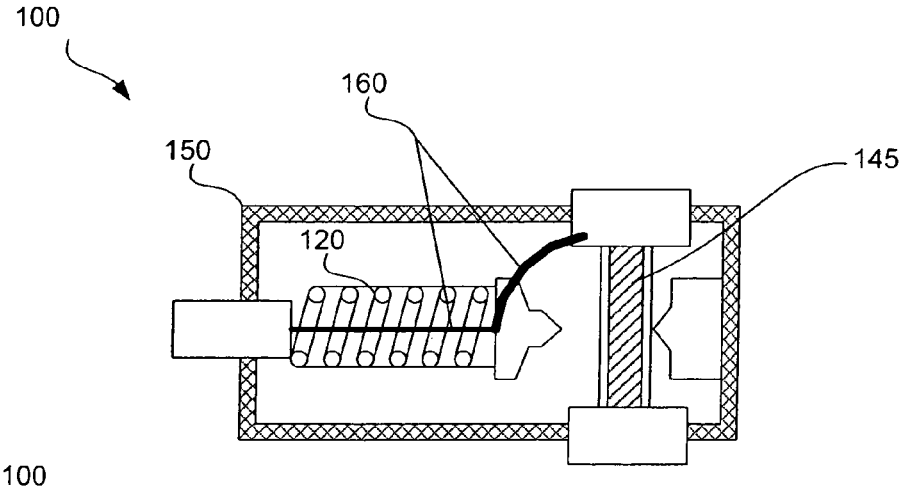
FIG. 2*a* is a cross sectional view of the first embodiment of the reflowable thermal fuse in an installation state.
Figure 2B:
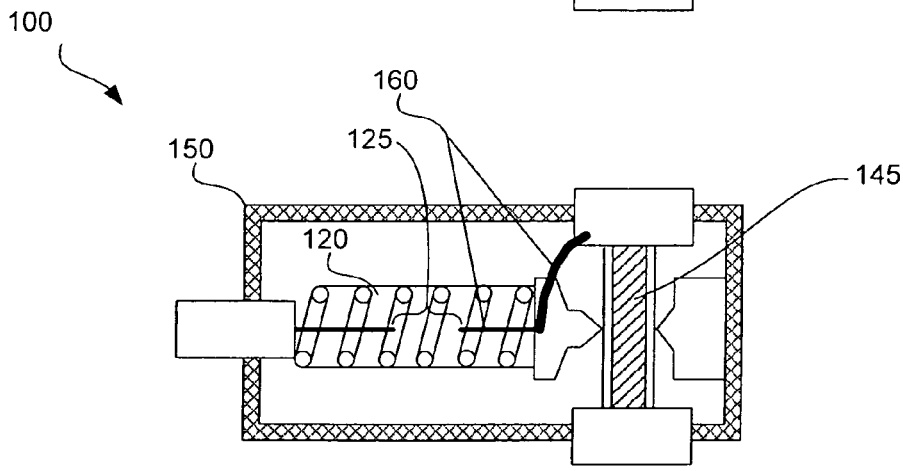
FIG. 2*b* is a cross sectional view of the first embodiment of the reflowable thermal fuse in an activated state.
Figure 2C:
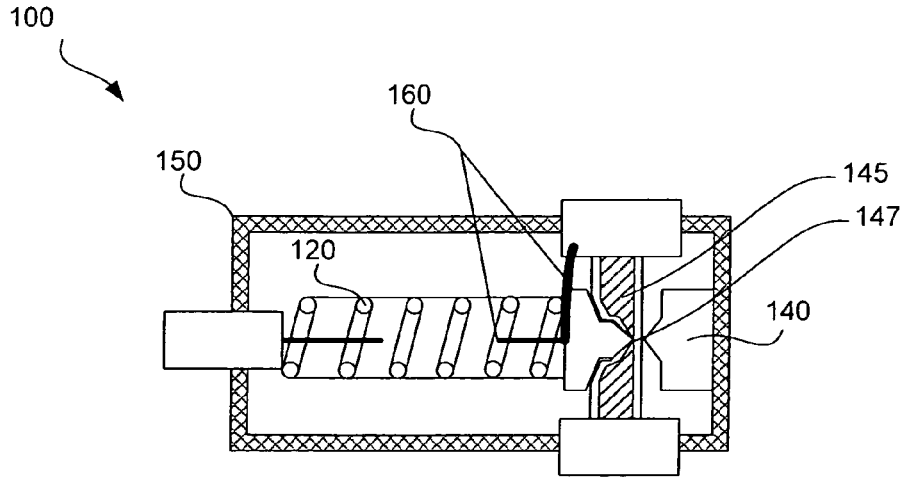
FIG. 2*c* is a cross sectional view of the first embodiment of the reflowable thermal fuse during a fault condition.

FIG. 2*a*-FIG. 2*c* illustrate various states of an embodiment of a reflowable thermal fuse. In FIG. 2*a*, the reflowable thermal fuse is in an installation state. In this state, the restraining element 160 is utilized to prevent the elastic element 120 from applying force on the conduction element 145. While in this state, the reflowable thermal fuse 100 may be installed on a circuit panel via a reflow oven. During the reflow process, the temperature of the reflowable thermal fuse 100 along with the rest of the panel is increased until the solder connecting the reflowable thermal fuse to the panel melts. At this temperature, the sensor 145*c* of the conduction element 145 may lose resilience and become susceptible to deformation and or breakage. As discussed earlier, the sensor 145*c* may be surrounded by an outer tube, as shown in FIG. 1. This may enable constraining the movement of the sensor 145*c* during the reflow process. Alternatively, the sensor 145*c* may be held in place via surface tension. After the reflowable thermal fuse 100 is soldered to the panel, the panel may be cooled off to allow the solder to solidify.

FIG. 2*b* illustrates an activated reflowable thermal fuse 100. The reflowable thermal fuse 100 may be activated after the reflow process above by passing an activating current through the restraining element 160. This causes an opening 125 in the restraining element 160 to form, thereby releasing the elastic element 120 so that it may apply force on the conduction and sensing element 145. The activating current may be applied to the restraining element 160 via the pads disposed around the housing 150 of the reflowable thermal fuse 100.

FIG. 2*c* illustrates a reflowable thermal fuse 100 during a fault condition. In this state, the reflowable thermal fuse 100 has been previously activated as described above. The ambient temperature surrounding the reflowable thermal fuse may reach a temperature, such as 200 degrees Celsius, that causes the sensor 145*c* to lose resilience and/or become susceptible to deformation. After this occurs, force applied via the elastic element 120 causes an opening 147 to form in the sensor 145*c*, thus preventing electrical current from flowing through the sensor 145*c* and therefore the conduction element 145.

Figure 3:
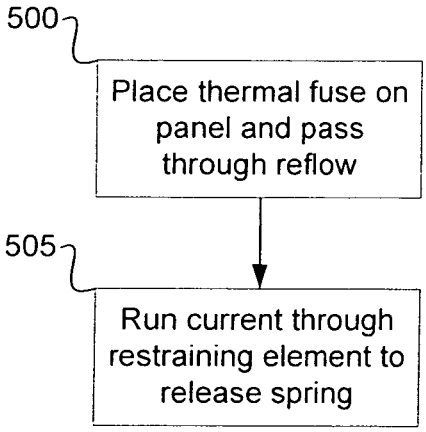
FIG. 3 is a flow diagram for installing a reflowable thermal fuse on a panel and activating the reflowable thermal fuse.

FIG. 3 is a flow diagram for installing a reflowable thermal fuse on a panel. At block 500, the reflowable thermal fuse is placed on a panel. For example, a reflowable thermal fuse, such as the reflowable thermal fuse 100 is placed on a panel. The reflowable thermal fuse 100 may be in the installation state as shown FIG. 2*a*. Solder paste may have been previously applied to the pad locations on the panel associated with the reflowable thermal fuse 100 via a masking process. The panel, with the reflowable thermal fuse, is then placed into a reflow oven which causes the solder on the pads to melt. After reflowing, the panel is allowed to cool.

At block 505, an activating current is run through pins of the reflowable thermal fuse so as to blow the restraining element. For example, referring to FIG. 1, 1 Ampere of current may be run through the first and third pads 110 and 105 so as to blow the restraining element 160 and allow the elastic element 120 to apply force on the conduction element 145. This operation places the reflowable thermal fuse in an activated state, as shown in FIG. 2*b*. Subsequent application of excessive heat to the reflowable thermal fuse may cause the sensor 145*c* to lose its resilience and/or become susceptible to deformation and/or breakage under the force applied by the elastic element.

As can be seen from the description above, the reflowable thermal fuse overcomes the problems associated with placement of thermal fuses on panels via reflow ovens. The restraining element enables securing the conduction element during the reflow process. Application of an activation current then activates the reflowable thermal fuse. Then during a subsequent fault condition the conduction element is opened.

Figure 4B:
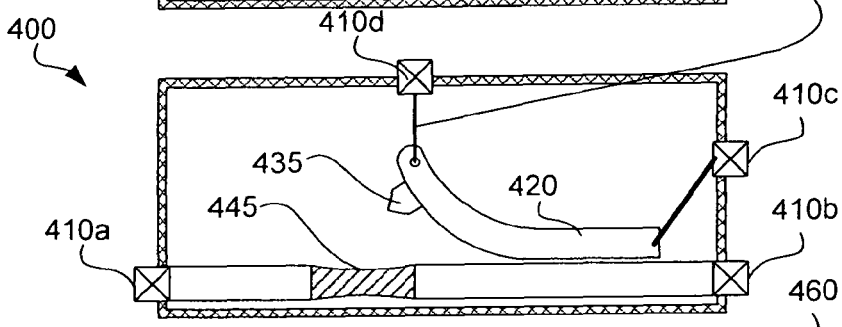
FIG. 4*b* is a cross sectional view of a second embodiment of a reflowable thermal fuse that utilizes four pads.
Figure 4C:
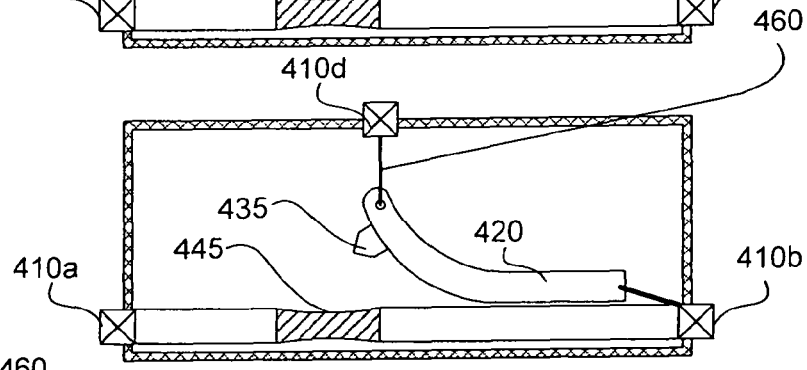
FIG. 4*c* is a cross sectional view of an embodiment of a reflowable thermal fuse that utilizes three pads.
Figure 4D:
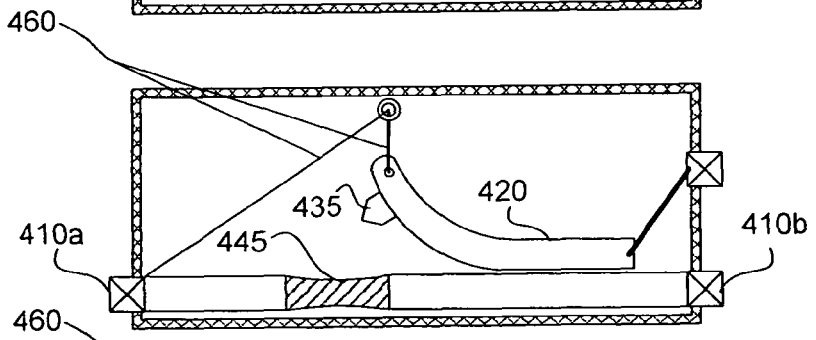
FIG. 4*d* is a cross sectional view of a second embodiment of a reflowable thermal fuse that utilizes three pads.
Figure 4E:
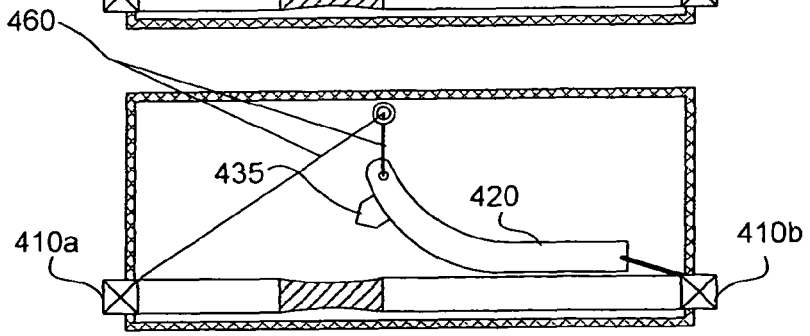
FIG. 4*e* is a cross sectional view of an embodiment of a reflowable thermal fuse that utilizes two pads.

While the reflowable thermal fuse and the method for using the reflowable thermal fuse have been described with reference to certain embodiments, it will be understood by those skilled in the art that various changes may be made and equivalents may be substituted without departing from the scope of the claims of the application. For example, referring to FIG. 4*a*, four pads (410*a*, 410*d*, 410*c*, and 410*b*) may be utilized instead of three. In this case, the activating current may be passed through a first and second pad (410*d* and 410*c*) to activate the reflowable thermal fuse 400. This results in the tip 435 coming into contact with the conduction element 445. As shown in FIG. 4*b*, the elastic element 420 may be utilized as a conductor and may be in electrical communication with a pad 410*c* so that the activating current flows through the elastic element 420 to the restraining wire 460 and opens the restraining wire 460. As shown in FIG. 4*c* and FIG. 4*d*, three pads (410*a*, 410*d*, and 410*b*) may be utilized and the activating current may flow through the elastic element 420. As shown in FIG. 4*e*, the same two pads (410*a*, 410*b*) through which the load current flows may be utilized to blow the restraining wire.

Figure 5A:
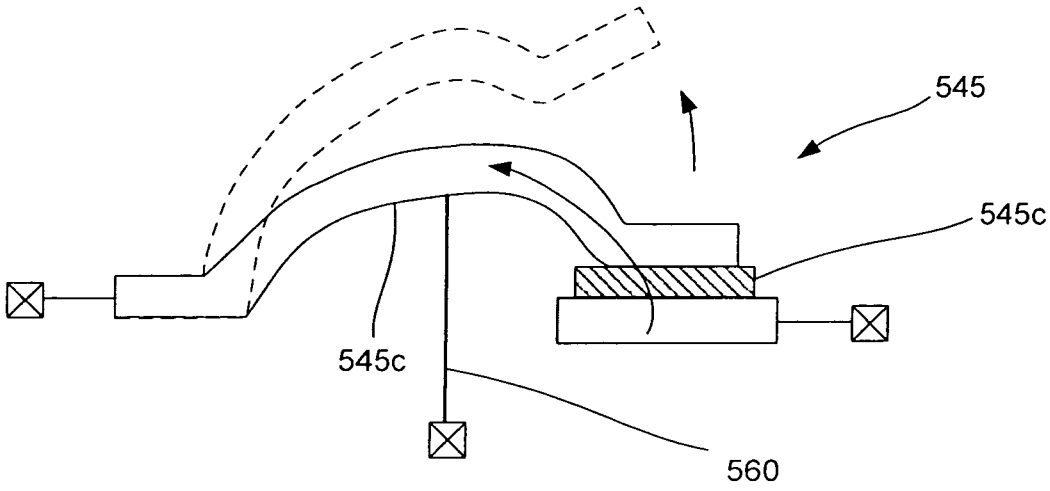
FIG. 5*a* is a first embodiment of a reflowable thermal fuse that utilizes a spring bar.
Figure 5B:
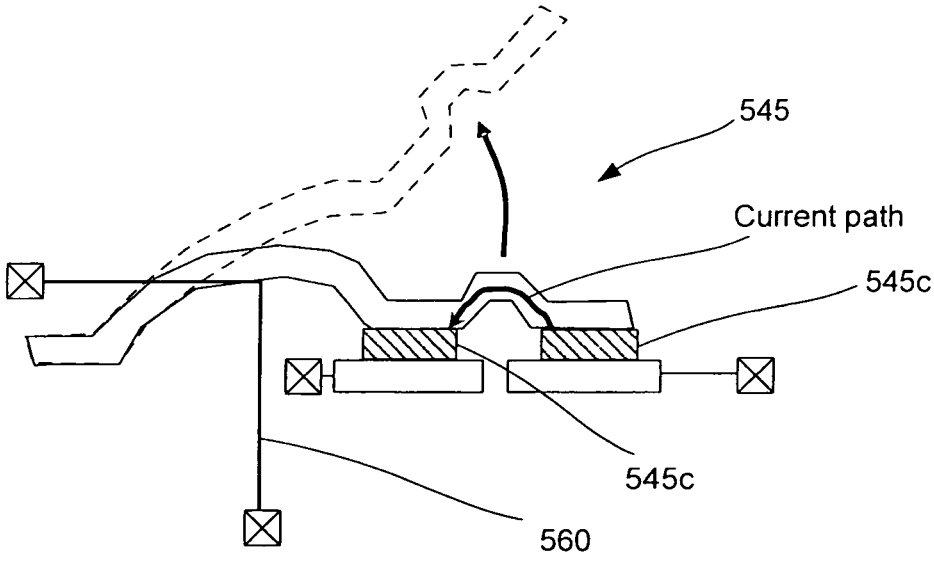
FIG. 5*b* is a second embodiment of a reflowable thermal fuse that utilizes a spring bar.

FIG. 5*a* and FIG. 5*b* are yet other alternatives embodiments contemplated by the Applicant. In FIG. 5*a*, a spring-bar 545 may be utilized. The spring-bar may be utilized as the conduction element 545 of the thermal fuse through which a load current flows. The conduction element 545 may include a portion that is in elastic tension, and also a sensor 545*c*. A restraining element 560 may be provided for holding the conduction element 545 in place during a reflow process. During normal operations, a load current may flow through the conduction element 545. After activation, or blowing of the restraining element 560, the conduction element 545 is held in place via the sensor 545*c*. During a fault condition, excessive heat causes the sensor 545*c* to lose its ability to hold the conduction element 545 in place and the conduction element 545 subsequently opens as shown.

In FIG. 5*b*, a portion of the spring bar 545 may correspond to a conduction element through which a load current flows under normal operating conditions as shown. As described above, once the thermal fuse is activated, subsequent application of excessive heat causes the sensor 545*c* to lose its ability to hold the conduction element 545 in place and the conduction element 545 subsequently opens as shown.

Figure 6A:
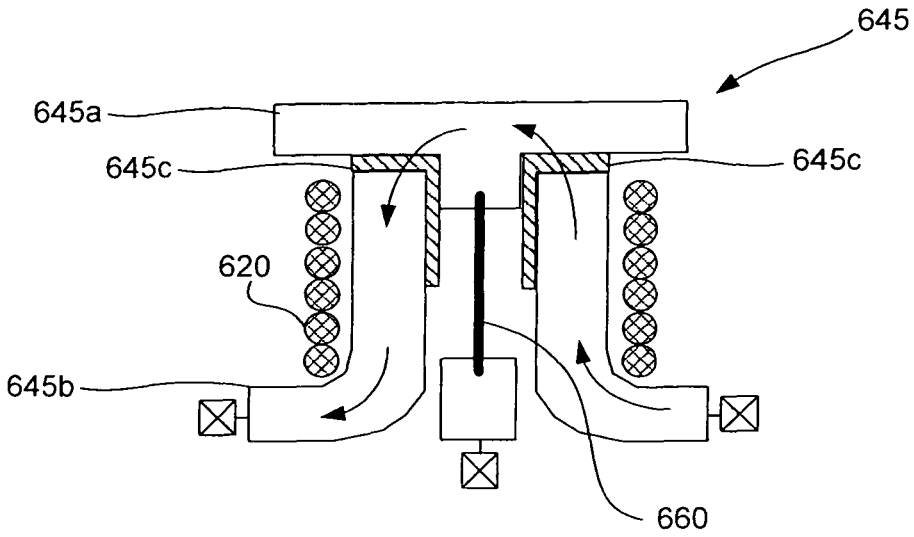
FIG. 6*a* is a cross-sectional view of yet another embodiment of a reflowable thermal fuse.
Figure 6B:
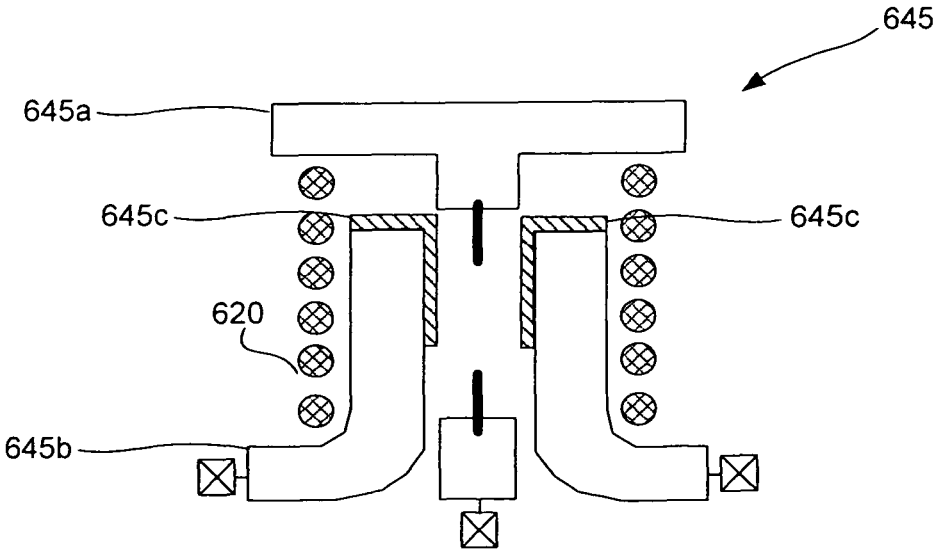
FIG. 6*b* is the reflowable thermal fuse of FIG. 6*a* after a fault condition has occurred.
Figure 7A:
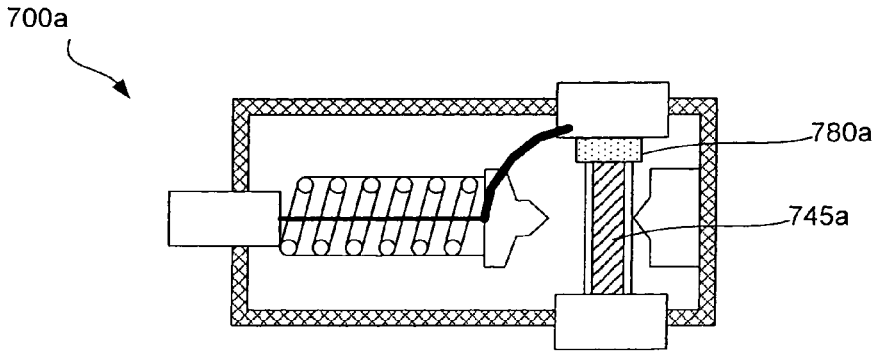
FIGS. 7*a*-7*e* illustrate various exemplary reflowable thermal fuse configurations that incorporate a heat producing device.
Figure 7B:
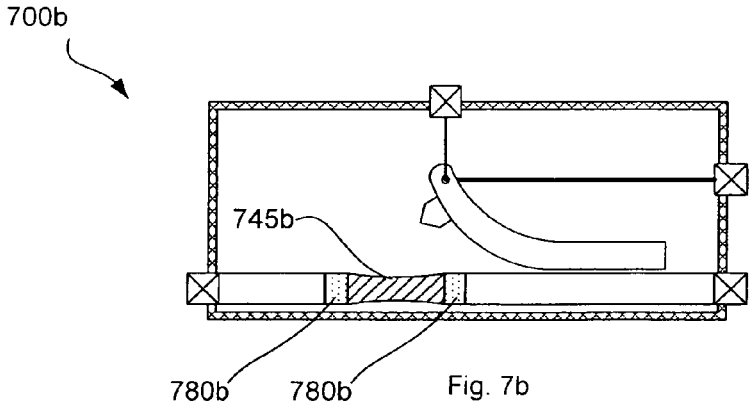
Figure 7C:
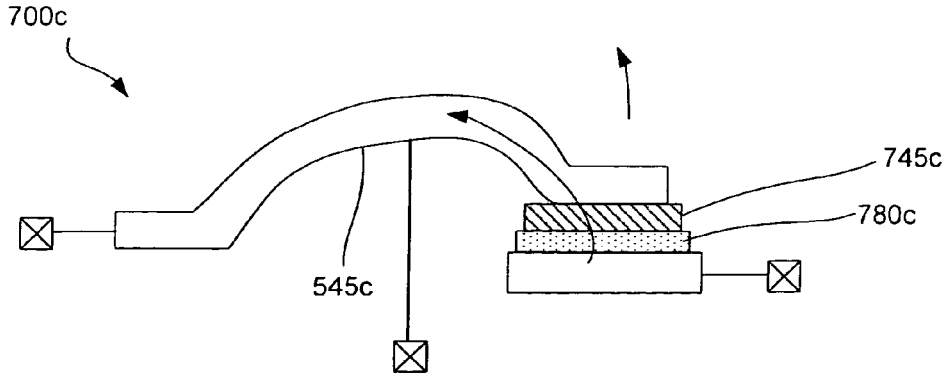
Figure 7D:
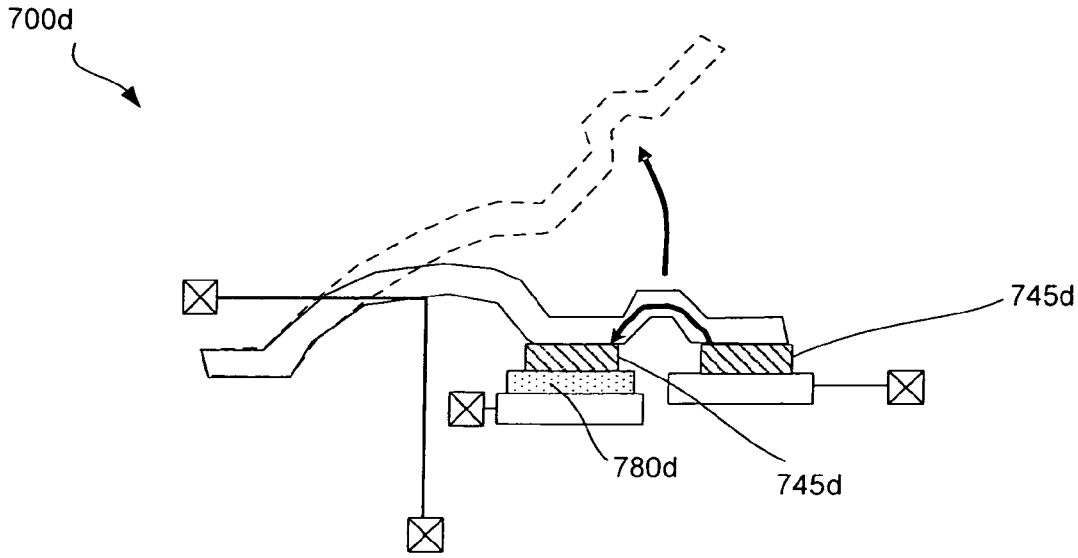
Figure 7E:
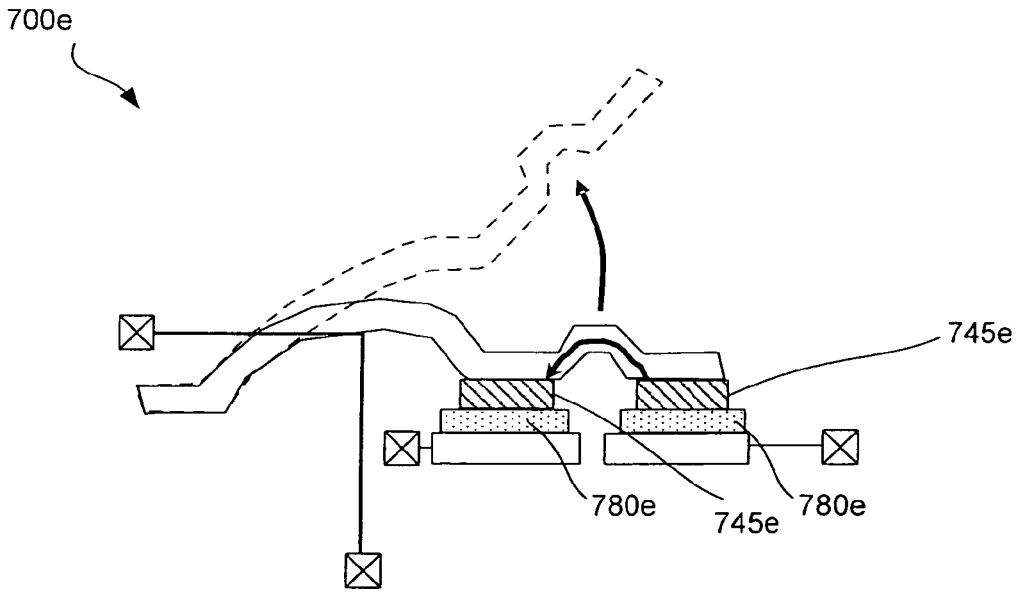

FIG. 6*a* is a cross-sectional view of yet another embodiment of a reflowable thermal fuse. In FIG. 6*a*, the conduction element 645 includes first and second portions 645*a* and 645*b*. A sensor 645*c* is disposed between the two portions and enables current to flow between the first and second portions 645*a* and 645*b*. An elastic element 620 that corresponds to a spring is rapped around the second portion 645*b* of the conduction element 645 and applies force between the first and second portions 645*a* and 645*b*. A restraining element 660 is provided to keep the first and second portions 645*a* and 645*b* of the conduction element 645 in place during reflow. An activation current is passed through the restraining element 660 to blow the restraining element 660. Subsequent application of excessive heat causes the sensor 645*c* to lose its ability to hold the two portions of the conduction element 645 in place, and the elastic element 620 forces the two portions to move apart as shown in FIG. 6*b*. This in turn subsequently opens the conduction element 645.

Applicants contemplate that there may be instances where the reflowable thermal fuse described above cannot react fast enough to a particular type of fault condition. For example, the sensor may not lose its resilience fast enough to protect a circuit from a cascade failure. Therefore, in alternative embodiments a positive-temperature-coefficient (PTC) device, such as the PTC device disclosed in U.S. application Ser. No. 12/383,560, filed Mar. 24, 2009, which is hereby incorporated by reference in its entirety, may be inserted in series with the conduction element to enable more rapid heating of the sensor due to the proximity of the PTC device to the sensor and $I^2R$ heating produced by the PTC device. Other heat producing devices, such as a conductive composite heater, that generate heat as a result of current flowing through the device, may be utilized in addition to or instead of the PTC device. In addition, the PTC device may provide overcurrent functionality that allows the fuse to become an overcurrent fuse, resulting in a permanent open.

FIGS. 7*a*-7*e* illustrate various exemplary reflowable thermal fuse configurations 700*a*-*e* that incorporate a heat producing device 780*a-e* such as the PTC device described above. As shown, the heat producing device 780*a-e* may be in electrical and/or mechanical communication with the conduction element 745*a-e*. Current may flow through the heat producing device 780*a-e* and continue on through the conduction element 745*a-e*. As the current flowing through the heat producing device 780*a-e* increases, the resistance of the heat producing device may increase resulting in an increase in the temperature of the heat producing device 780*a-e*. The increase in temperature may cause the conduction element to lose resilience more quickly resulting in an open circuit condition.

While the reflowable thermal fuse and the method for using the reflowable thermal fuse have been described with reference to certain embodiments, it will be understood by those skilled in the art that various changes may be made and equivalents may be substituted without departing from the scope of the claims of the application. For example, one of ordinary skill will appreciate that the heat producing device described above may be adapted to work with any of the reflowable thermal fuse embodiments disclosed herein, or any equivalents thereof, so as to enhance the operating characteristics of the reflowable thermal fuse. In addition, many modifications may be made to adapt a particular situation or material to the teachings without departing from its scope. Therefore, it is intended that reflowable thermal fuse and method for using the reflowable thermal fuse are not to be limited to the particular embodiments disclosed, but to any embodiments that fall within the scope of the claims.

We claim:

1. A reflowable, surface-mountable thermal fuse comprising:

a conduction element with first and second ends;

a sensor in mechanical communication with the conduction element;

an elastic element adapted to apply force on the conduction element in an activated state of the thermal fuse;

a plurality of mounting pads that enable surface mounting the thermal fuse; and a restraining element adapted to secure the elastic element and thereby prevent the elastic element from applying force on the conduction element in an installation state of the thermal fuse, wherein application of an activating current through the restraining element causes the restraining element to break and thereby release the elastic element and place the thermal fuse in the activated state without severing the conduction element, allowing opening of the conduction element during a subsequent fault condition.

2. The thermal fuse according to claim 1, wherein when an ambient temperature around the thermal fuse exceeds a threshold, the sensor loses resilience and becomes subject to deformation and allows the conduction element to open under the force applied by the elastic element.

3. The thermal fuse according to claim 1, wherein the sensor comprises solder.

4. The thermal fuse according to claim 1, wherein the elastic element corresponds to a spring.

5. The thermal fuse according to claim 4, wherein the spring corresponds to a coil spring.

6. The thermal fuse according to claim 4, wherein the spring corresponds to a leaf spring.

7. The thermal fuse according to claim 1, wherein the elastic element comprises an electrically conductive material.

8. The thermal fuse according to claim 1, wherein a tip of the elastic element is tapered so as to concentrate the force applied by the elastic element in the tip.

9. The thermal fuse according to claim 1, wherein the plurality of mounting pads are disposed at least partially outside of a housing that enable surface mounting the thermal fuse to a panel.

10. The thermal fuse according to claim 9, wherein the first and second ends of the conduction element are in electrical communication with first and second mounting pads of the plurality of mounting pads.

11. The thermal fuse according to claim 10, wherein the restraining element includes first and second ends that are in electrical communication with third and forth mounting pads of the plurality of mounting pads.

12. The thermal fuse according to claim 10, wherein the restraining element includes a first end that is in electrical communication with at least one of the first and second mounting pads, and a second end that is in electrical communication with a third pad of the plurality of mounting pads.

13. The thermal fuse according to claim 10, wherein the restraining element includes first and second ends that are in electrical communication with the first and the second mounting pads, respectively, of the plurality of mounting pads.

14. The thermal fuse according to claim 1, wherein the restraining element comprises a first region adapted to open when the activating current flows through the restraining element and a second region adapted to not open when the activating current flows through the restraining element.

15. A reflowable, surface-mountable thermal fuse comprising:

a conduction element comprising an outer tube with first and second ends;

a sensor in mechanical communication with the conduction element, said sensor being contained by the outer tube which is adapted to contain the sensor when the sensor loses resilience and melts;

an elastic element adapted to apply force on the conduction element in an activated state of the thermal fuse;

a plurality of mounting pads that enable surface mounting the thermal fuse; and a restraining element adapted to secure the elastic element and thereby prevent the elastic element from applying force on the conduction element in an installation state of the thermal fuse, wherein application of an activating current through the restraining element causes the restraining element to break and thereby release the elastic element and place the thermal fuse in the activated state without severing the conduction element; and wherein under a fault condition causing the sensor to lose resilience and melt, force applied by the elastic element causes an opening to form in the sensor to prevent current from flowing through the sensor.

16. A reflowable, surface-mountable thermal fuse comprising:

a conduction element with first and second ends;

a sensor in mechanical communication with the conduction element;

a heat producing device in electrical communication with the sensor adapted to generate heat during a fault condition, the generated heat causing the sensor to lose resilience;

an elastic element adapted to apply force on the conduction element in an activated state of the thermal fuse;

a plurality of mounting pads that enable surface mounting the thermal fuse; and a restraining element adapted to secure the elastic element and thereby prevent the elastic element from applying force on the conduction element in an installation state of the thermal fuse, wherein application of an activating current through the restraining element causes the restraining element to break and thereby release the elastic element and place the thermal fuse in the activated state without severing the conduction element, allowing opening of the conduction element during a subsequent fault condition.

17. The thermal fuse according to claim 16, wherein the heat producing device corresponds to a positive-temperature-coefficient (PTC) device.

18. The thermal fuse according to claim 16, wherein the restraining element comprises a first region adapted to open when the activating current flows through the restraining element and a second region adapted to not open when the activating current flows through the restraining element.

19. A reflowable, surface-mountable thermal fuse comprising:

a housing with a plurality of pads that enable mounting the thermal fuse via a surface mount technique;

first, second, and third pads of the plurality of pads disposed at least partially outside of the housing;

a conduction element with first and second ends, disposed within the housing and in electrical communication with the first and second pads;

an elastic element disposed within the housing and adapted to apply force on the conduction element in an activated state of the thermal fuse; and a restraining element with a first end in electrical communication with the first pad and a second end in electrical communication with the third pad, wherein the restraining element is adapted to secure the elastic element and thereby prevent the elastic element from applying force on the conduction element in an installation state of the thermal fuse, and wherein application of an activating current through the first pad to the third pad causes the restraining element to break and thereby release the elastic element and place the thermal fuse in the activated state without severing the conduction element, allowing opening of the conduction element during a subsequent fault condition.

20. The thermal fuse according to claim 19, wherein when an ambient temperature around the thermal fuse exceeds a threshold, the sensor loses resilience and becomes susceptible to deformation and the conduction element opens under the force applied by the elastic element.

* * * * *